United States Patent [19]

Bouquet

[11] 4,112,883

[45] Sep. 12, 1978

[54] INTERNAL COMBUSTION ENGINE FIT-UP DEVICE

[75] Inventor: Jean-Claude Bouquet, Pantin, France

[73] Assignee: Societe d'Etudes de Machines Thermiques, Saint-Denis, France

[21] Appl. No.: 795,911

[22] Filed: May 11, 1977

Related U.S. Application Data

[63] Continuation of Ser. No. 639,923, Dec. 11, 1975, abandoned, which is a continuation of Ser. No. 461,889, Apr. 18, 1974, abandoned.

[30] Foreign Application Priority Data

Aug. 13, 1973 [FR] France ..... 73 29568

[51] Int. Cl.[2] ..... F02B 75/18

[52] U.S. Cl. ..... 123/52 M; 123/195 R

[58] Field of Search ..... 123/52M, 52 MV, 52 MC, 123/195 R, 195 A, 32 R; 115/0.5 B

[56] References Cited

PUBLICATIONS

Lubrication, vol. 44, May 1958, #5, p. 66.

Diesel and High Compression Gas Engines, Edgar J. Kales, 6/18/65, pp. 337, 342, 353.

Diesel Engineering Handbook, Karl W. Stinson, 11th ed., 1963, Diesel Publications, Inc., p. 330.

*Primary Examiner*—Ronald H. Lazarus

*Attorney, Agent, or Firm*—Kenyon & Kenyon, Reilly, Carr & Chapin

[57] ABSTRACT

The invention relates to an internal combustion engine fit-up device, according to which each intake manifold is arranged at a level lower than that of the associated cylinder head, a walkway is mounted above each intake manifold, and the engine pipes are mounted in the space between the said walkway and the said intake manifold.

7 Claims, 1 Drawing Figure

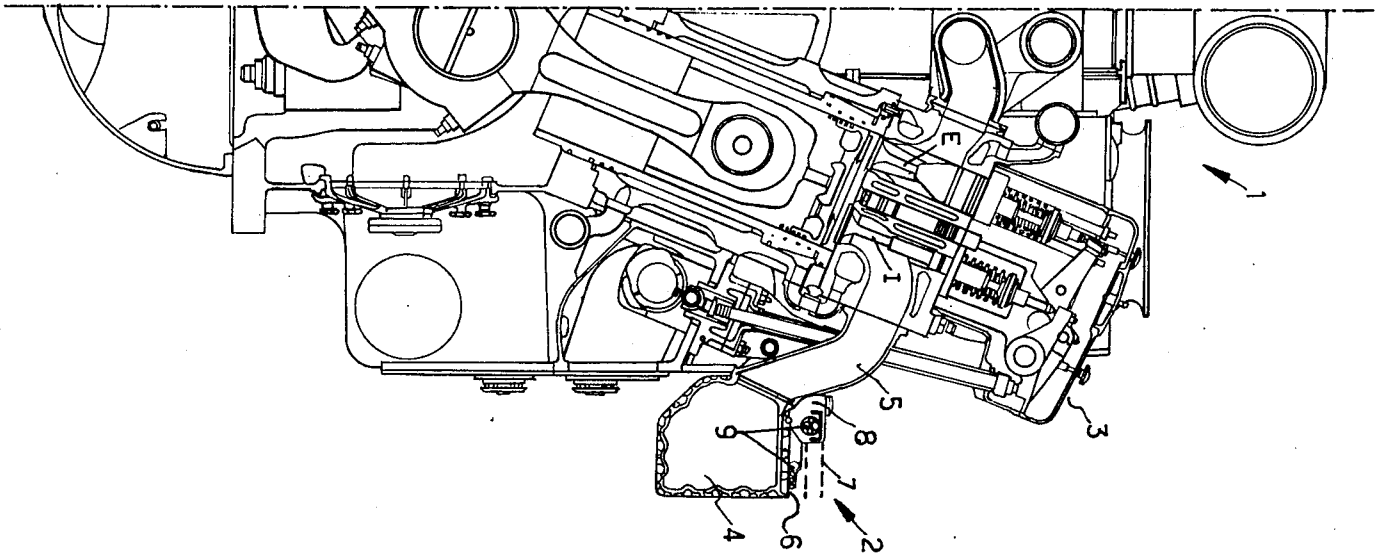
1
3
E
I
5
8
7
2
6
9
4

INTERNAL COMBUSTION ENGINE FIT-UP DEVICE

This is a continuation of application Ser. No. 639,923, filed Dec. 11, 1975, now abandoned, (which latter) in turn is a continuation of application Ser. No. 461,889, filed Apr. 18, 1974, now abandoned.

The present invention has for its object an internal combustion engine fit-up device. This device is particularly applicable to large-sized engines such as those used, for example, in ships of vessels.

The engines of this type being very high, the cylinder heads with the associated intake manifolds and the pipes are located at a relatively high level above the floor. This location not only makes the maintenance of these high portions difficult, but becomes still more inconvenient where certain repair and mounting work have to be performed, for it is necessary to provide for particular means intended to give the person performing the work a ready access to these portions and a sufficient available working space.

To this end, it was the usual practice, up to the present, to place beside the engine working platforms or scaffolds. But such means do not constitute a satisfactory solution, since, owing to their arrangement on the floor beside the engine, they further increase the occupied room in an available space which most often is already quite limited.

Another drawback inherent in the structure of known engines is due to the fact that the intake manifolds are located very close to the cylinder head and therefore complicate the access to the latter and the pipes.

The present invention proposes an optimum solution of the maintenance and mounting problem raised by large-sized engines, which eliminate the aforesaid drawbacks. This aim is attained by incorporating with the engine a fit-up device without increasing the space occupied by the engine.

To this end, the device according to the invention is characterized in that each intake manifold is arranged at a level lower than that of the associated cylinder head, a walkway is mounted above each intake manifold and the engine pipes are mounted in the space between the said walkway and the said intake manifold.

According to another feature of the invention, each walkway comprises removable flooring panels, floor traps or the like giving access to the said pipes.

This improvement in the engine structure is quite advantageous, for it allows the pipes to be grouped in a bundle, or the set of pipes associated with a cylinder head to be prefabricated or the intake manifold and the corresponding pipes to be prefabricated, in the form of assemblies ready to be mounted.

Other features and advantages of the invention will appear more clearly from the following detailed description made with reference to the appended diagrammatic drawing given solely by way of nonlimitative example illustrating a preferred form of embodiment of the invention and the single FIGURE of which is a half-cross-sectional view of the internal combustion engine fit-up device according to the invention, arranged above an intake manifold of the engine.

The FIGURE shows an internal combustion engine 1 on which is mounted a fit-up device 2 according to the invention.

In the following, only the engine arrangements forming the subject matter of the invention will be described.

In the upper portion of the FIGURE is seen the cylinder head 3 containing, in a manner known per se, the valve-rocker mechanisms, the intake valves I and exhaust valves E, etc. The intake manifold 4 secured on the frame is arranged longitudinally at a level lower than that of the cylinder head 3. The manifold is connected to the cylinder head through a conduit 5.

The intake manifold 4 is so conformed and mounted as to present a top surface 6 which is for example at least approximately plane and substantially horizontal. Above this upper face 6 is arranged a walkway 7. The latter is secured through the intake manifold 4 through the medium of a support device 8 which is also located on the said horizontal surface 6. Between the walkway 7 and the upper face 6 of the manifold are placed engine pipes 9 grouped in bundles. These bundles of pipes comprising water pipes for the injection nozzles, the pipes for the lubrication means particularly of the valve-rocker arms, pipes possibly for the electrical cables for fuel preheating, tubes possibly for compressed air for engine starting and servo-control and regulator and fuel supply pipes conventionally required for operation of engine of this type as is known to persons skilled in the art.

To ensure the access to the pipes 9 from the walkway 7, the later comprises removable flooring panels, floor traps or the like (not shown).

The advantage of the invention appears clearly from the FIGURE owing to the walkway being mounted above the manifold, it allows the persons entrusted with the maintenance of the engine to move about in the space which is located within the apparent size contour circumscribed by the cylinder head 3 and the intake manifold 4. The space about the cylinder head 3 is therefore freed and ready access to the latter is thus ensured from the walkway 7. The fit-up device 2 is therefore incorporated with the engine without the latter occupying more space than the known engines.

Modified forms of embodiment of the device illustrated in the FIGURE are possible without departing from the scope of the invention.

Thus, the walkway, instead of resting upon the intake manifold, can be secured to the engine case. The pipes can be prefabricated before being mounted on the engine. It is even possible to prefabricate the manifold with the pipes in a single assembly before mounting them on the engine.

Of course, the invention is by no means limited to the form of embodiment described and illustrated, which has been given by way of example only. In particular, it comprises all the means constituting technical equivalents to the means described as well as their combinations, should the latter be carried out according to the spirit of the invention and used within the scope of the following claims.

What is claimed is:

1. An internal combustion engine fit-up device for large sized Diesel engines provided with intake and exhaust valve means for controlling the intake of air and the exhaust of the combustion gases respectively, and installable in locations of vehicles wherein the available space in said locations is very small, comprising a Diesel engine provided with said intake and exhaust valve means, intake manifolds for said engine, associated cylinder heads and engine pipes requisite for engine operation, said intake and said exhaust valve means being located in said cylinder heads, wherein each said intake manifold is arranged at a level lower than that of its associated cylinder head, each said manifold presenting a top surface that is approximately plane and horizontal, supporting means located on said top surface, and a walkway mounted by said means above each said intake manifold and providing a space between said surface of each said manifold and the under face of said walkway, and wherein said engine pipes are located in said space between said walkway and said intake manifold, so as to eliminate obstruction of said cylinder heads and provide free access to said cylinder heads and other engine parts located above said walkway.

2. A device according to claim 1, wherein the pipes are grouped in bundles.

3. A device according to claim 1, wherein the whole set of pipes associated with a cylinder head is prefabricated.

4. A device according to claim 1, wherein each said intake manifold and the corresponding pipes form a prefabricated assembly.

5. A device according to claim 1 wherein said pipes are secured on the top face of the associated intake manifold.

6. A device according to claim 1 wherein pipes are secured on independent support means.

7. Diesel engine installable in locations wherein the available space is very small, comprising intake manifolds for said engine, associated cylinder heads, intake and exhaust valve means for controlling the intake of air and the exhaust of the combustion gases respectively, said valve means being located in said cylinder heads, engine pipes requisite for engine operation and walkway means provided in the zone around the cylinder heads, wherein said intake manifolds are arranged at a level lower than that of the respective associated cylinder heads, each manifold presenting a top surface that is approximately plane and horizontal, supporting means located on said top surface, and a walkway mounted by said means above each said intake manifold and providing a space between said surface of each said manifold and the under face of said walkway, and wherein said engine pipes are located in said space between said walkway and said intake manifolds, so as to eliminate obstruction of said cylinder heads and provide free access to said cylinder heads and other engine parts located above said walkway.

* * * * *

UNITED STATES PATENT AND TRADEMARK OFFICE

CERTIFICATE OF CORRECTION

PATENT NO. : 4,112,883

DATED : September 12, 1978

INVENTOR(S) : Jean Claude Bouquet

It is certified that error appears in the above-identified patent and that said Letters Patent are hereby corrected as shown below:

Column 1, line 11: change "of" to --or--.

Column 2, line 17: after "comprising" insert --cooling--.

Column 2, line 23: change "engine" to --engines--.

Column 2, line 26: change "later" to --latter--.

Signed and Sealed this

*Second* Day of *January 1979*

[SEAL]

*Attest:*

RUTH C. MASON
*Attesting Officer*

DONALD W. BANNER
*Commissioner of Patents and Trademarks*